US006135819A

United States Patent [19]

Lin

[11] Patent Number: 6,135,819

[45] Date of Patent: Oct. 24, 2000

[54] TELECOMMUNICATION SOCKET CAPABLE OF DIRECTLY INSERTING OR CONNECTING WITH A MODULARIZED CIRCUIT

[76] Inventor: Chang-Liang Lin, 13F-1, No. 10, Kuo-Ting 1st St., Taoyuan City, Taiwan

[21] Appl. No.: 09/314,883

[22] Filed: May 19, 1999

[51] Int. Cl.[7] ..... H01R 13/66; H01R 33/945

[52] U.S. Cl. ..... 439/620; 439/676

[58] Field of Search ..... 439/676, 620

[56] References Cited

U.S. PATENT DOCUMENTS

| | | | |
|---|---|---|---|
| 5,069,641 | 12/1991 | Sakamoto et al. | 439/676 |
| 5,364,294 | 11/1994 | Hatch et al. | 439/676 |
| 5,456,619 | 10/1995 | Belopolsky et al. | 439/676 |
| 5,586,914 | 12/1996 | Foster, Jr. et al. | 439/676 |
| 5,599,209 | 2/1997 | Belopolsky | 439/676 |
| 5,687,233 | 11/1997 | Loudermilk et al. | 439/676 |

*Primary Examiner*—Neil Abrams
*Assistant Examiner*—Hae Moon Hyeon
*Attorney, Agent, or Firm*—Dougherty & Troxell

[57] ABSTRACT

A telecommunication socket capable of directly inserting or connecting with a modularized circuit, including a seat body and multiple first and second conductive wires. The seat body has four side walls defining a front insertion hole in which a plug can be fitted. The front ends of the first conductive wires are positioned on inner upper side of the seat body, while the rear ends of the first conductive wires extend out of the back face of the seat body. The second conductive wires are bent and positioned on lower side of the seat body with one end extending out of the back face of the seat body and with the other end extending out of the bottom face of the seat body. A modularized circuit board or an electronic element can be easily directly additionally connected between the rear ends of the first conductive wires and upper ends of the second conductive wires on the back face of the seat body.

7 Claims, 3 Drawing Sheets

TELECOMMUNICATION SOCKET CAPABLE OF DIRECTLY INSERTING OR CONNECTING WITH A MODULARIZED CIRCUIT

BACKGROUND OF THE INVENTION

The present invention relates to an improved telecommunication socket, and more particularly to a telecommunication socket which includes two-stage conductive wires enabling a modularized circuit board or an electronic element to be easily and directly additionally connected with the socket so as to expand the function.

FIGS. 1 and 2 show a conventional telecommunication (telephone) socket including a seat body 11 having four side walls defining an insertion hole in which a plug can be fitted, and multiple bent conductive wires 12. A front section of the conductive wire is bent into an acute angle in a front end of the seat body 11, while a rear section of the conductive wire is bent 90 degrees to extend out of the bottom face of the seat body 11. The transmission lines contained in the plug contact with the respective conductive wires 12 of the seat body 11 so as to connect with a telecommunication device via the conductive wires 12.

The conventional telecommunication socket simply has the above telecommunication connection function, while lacking any other effect. Therefore, if it is desired to enhance the telecommunication quality of a product (such as a telephone) or provide other function, a circuit board or an electronic element must be additionally installed before the respective conductive wires 12 of the socket are externally connected with the original functional circuit board of the product. Such procedure is troublesome and makes the entire circuit board of the product more complicated. Also, this renders more difficult in later maintenance or service of the product.

SUMMARY OF THE INVENTION

It is therefore a primary object of the present invention to provide a telecommunication socket capable of directly inserting or connecting with a modularized circuit. In the telecommunication socket, the original directly downward bent and extended conductive wire in the seat body is replaced by a two-stage conductive wire including a first and a second conductive wires. The rear ends of the first conductive wires and the upper ends of the second conductive wires extend out of the back face of the seat body. The front ends of the first conductive wires and the lower ends of the second conductive wires respectively extend into the seat body and out of the bottom face of the seat body. A modularized circuit board or electronic circuit box or an electronic element can be easily directly additionally connected between the rear ends of the first conductive wires and upper ends of the second conductive wires on the back face of the seat body so as to enhance the quality or expand the function without complicating the original circuit board or leading to inconvenience in later maintenance or service.

The present invention can be best understood through the following description and accompanying drawings wherein:

DETAILED DESCRIPTION OF THE PREFERRED EMBODIMENTS

Figure 1:
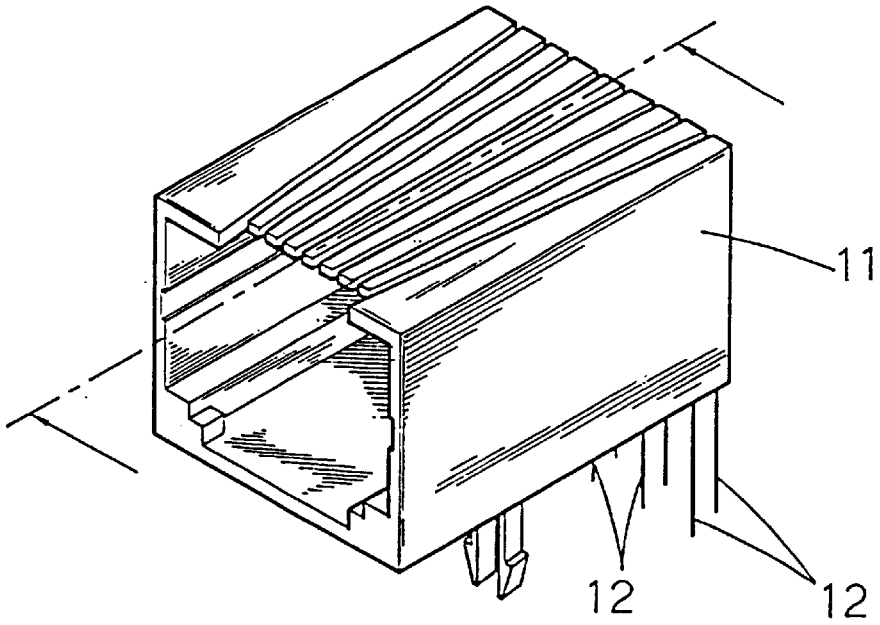
Fig. 1 (Prior Art)
FIG. 1 is a perspective view of a conventional telecommunication socket.
Figure 2:
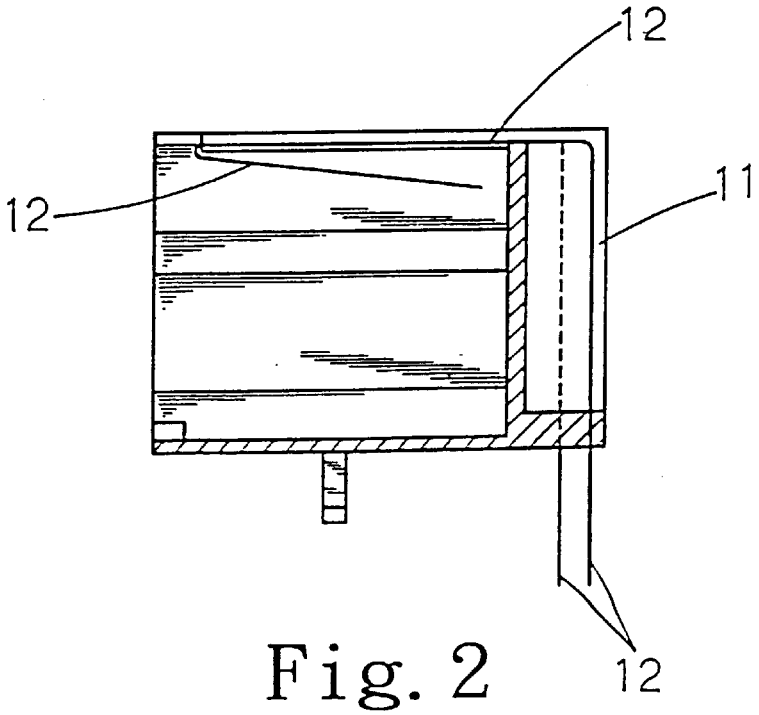
Fig. 2 (Prior Art)
FIG. 2 is a sectional view of the conventional telecommunication socket of FIG. 1.
Figure 3:
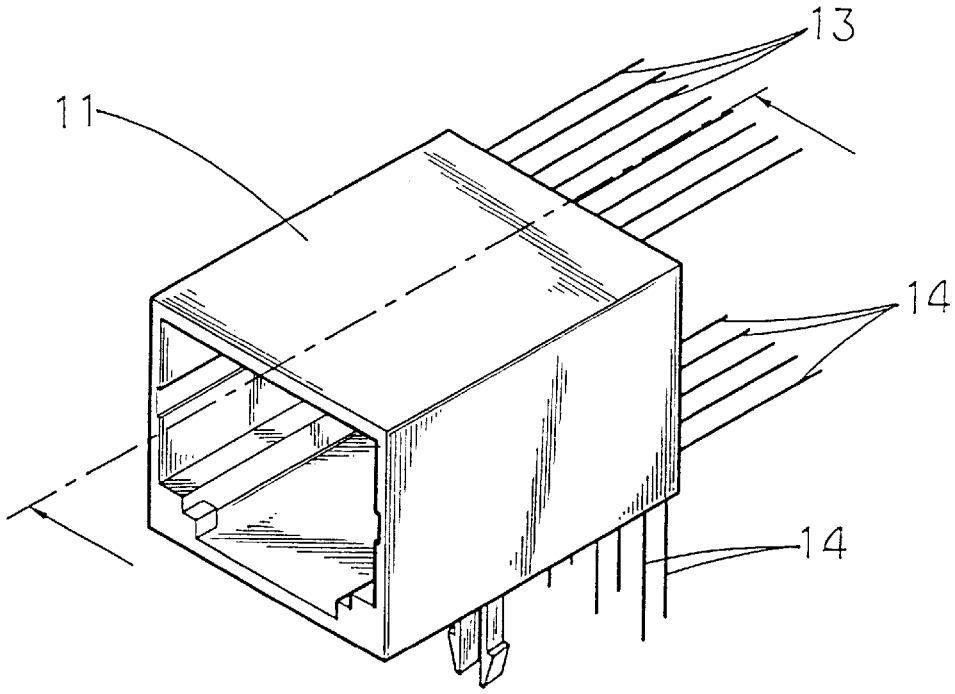
FIG. 3 is a perspective view of a first embodiment of the present invention.
Figure 4:
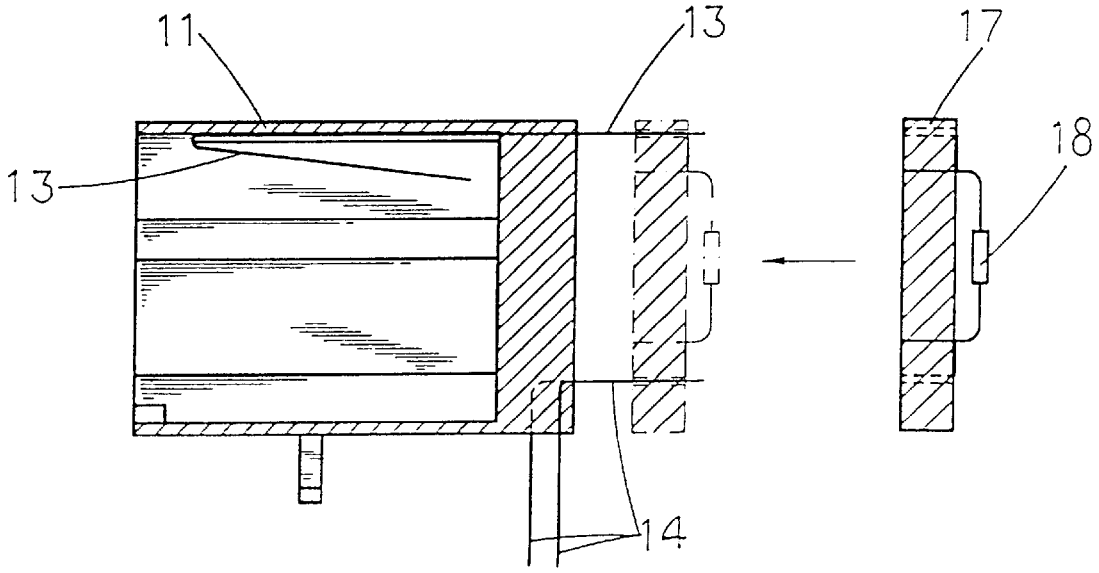
FIG. 4 is a sectional view showing that a modularized circuit is added to the telecommunication socket of the first embodiment.

Please refer to FIGS. 3 and 4. According to a first embodiment of the present invention, the telecommunication socket of the present invention includes a seat body 11 and multiple groups of two-stage conductive wires each including a first conductive wire 13 and a second conductive wire 14. The seat body 11 has four side walls defining a front insertion hole in which a plug (not shown) can be fitted. The first conductive wire 13 is positioned on inner upper side of the seat body 11 with its rear end extending out of the back face of the seat body 11 as a cantilever. The second conductive wire 14 is positioned near a lower side of the seat body 11 with one end extending out of the back face of the seat body 11 as a cantilever in parallel to the first conductive wire 13 and with the other end extending out of the bottom face of the seat body 11. Accordingly, when it is desired to enhance the quality of the telecommunication product or increase the function thereof, a circuit board 17 or an electronic element 18 can be additionally easily connected between the rear end of the first conductive wire 13 and the upper end of the second conductive wire 14 which are parallel to each other. Accordingly, a simple electronic circuit or element 18 such as a high frequency choke coil, a resistor, a capacitor, an inductor, a mini-type transformer can be directly added to the back face of the seat body 11 for eliminating noise or simplifying the circuit. Moreover, according to the design of the present invention, the object of modularization can be easily achieved. The above electronic element 18 can be replaced by a conductive wire to achieve the same function of the conventional telecommunication socket. Alternatively, the first conductive wires 13 of the back face of the seat body can be inserted with the conventional telecommunication socket conductive wires or bus terminal on the circuit board to achieve the same function.

Figure 5:
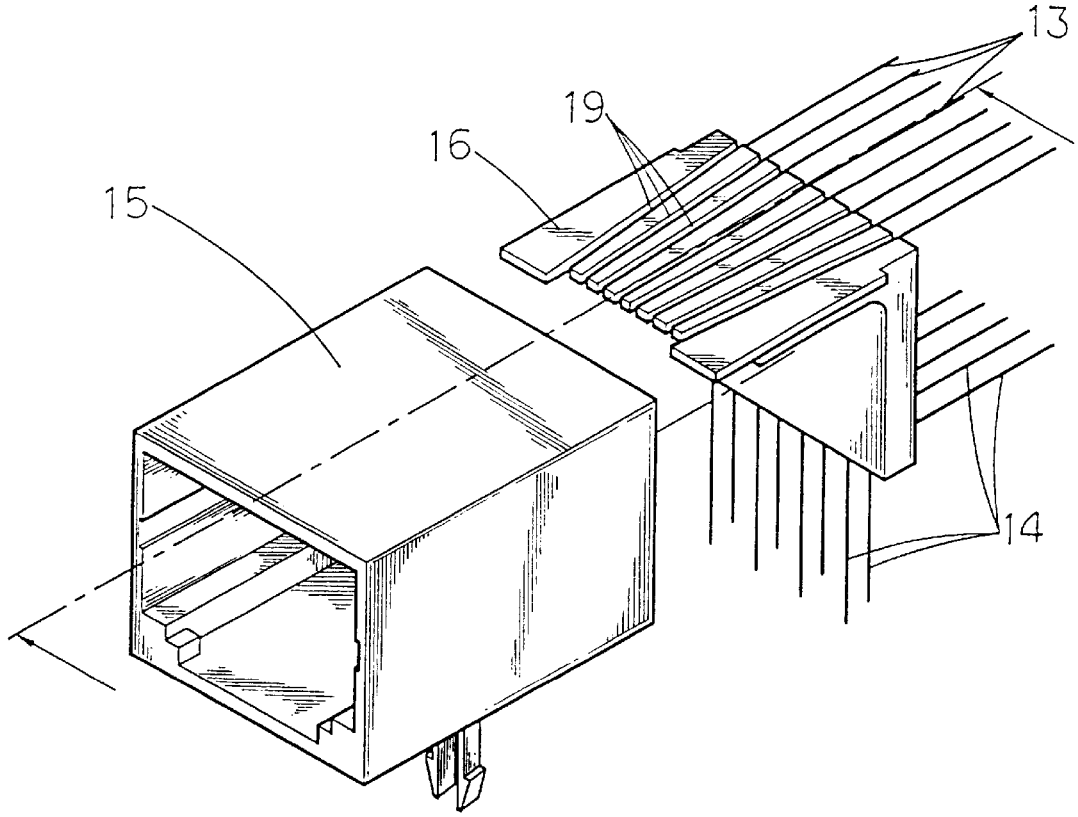
FIG. 5 is a perspective view of a second embodiment of the present invention.
Figure 6:
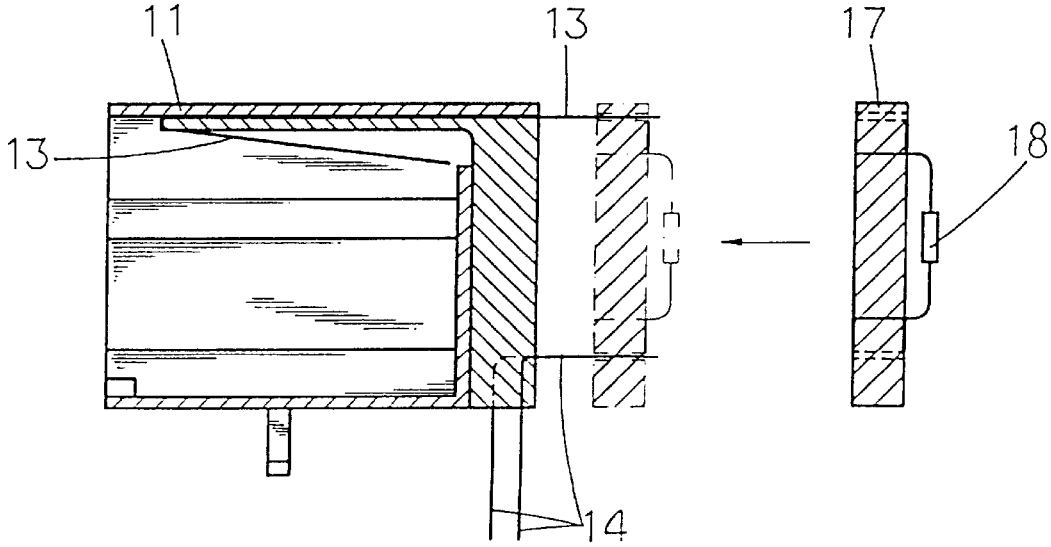
FIG. 6 is a sectional view showing that a modularized circuit is added to the telecommunication socket of the second embodiment.

FIGS. 5 and 6 show a second embodiment of the present invention, which includes a front seat body 15 and a rear seat body 16 assembled therewith and multiple groups of two-stage conductive wires each including a first conductive wire 13 and a second conductive wire 14. The front seat body 15 has four side walls defining a front insertion hole in which a plug can be fitted. The rear seat body 16 is a rack body which can be inserted with rear side of the front seat body 15 and is formed with multiple guide rails 19 on upper side. The front ends of the first conductive wires 13 are positioned in the guide rails 19, while the rear ends thereof extend out of the rear end of upper side of the rear seat body 16 as a cantilever. The second conductive wires 14 are positioned on lower side of the rear seat body 16 with one end extending out of the back face of the rear seat body 16 as a cantilever in parallel to the first conductive wires 13 and with the other end extending out of the bottom face of the rear seat body 16. The front and rear seat bodies 15, 16 are assembled with each other to form a seat body 11 as the first embodiment. As in the first embodiment, a circuit board 17 (module) or an electronic element 18 can be additionally easily added to the back face of the rear seat body 16 to achieve the same function as the first embodiment. This facilitates use and maintenance of the product.

In manufacturing, in order to facilitate use, multiple seat bodies 11 can be manufactured in combination with each other. The modules inserted with the rear ends of the seat bodies 11 can be also combined in cooperation with the seat bodies 11.

The above embodiments are only used to illustrate the present invention, not intended to limit the scope thereof. Many modifications of the above embodiments can be made without departing from the spirit of the present invention.

What is claimed is:

1. A telecommunication socket comprising:

a) an integral, one-piece seat body having a planar back face and a lower side;

b) a plurality of first conductive wires mounted in an upper portion of the integral, one-piece seat body such that first portions of the first conductive wires extend outwardly from the planar back surface in cantilevered fashion; and c) a plurality of second conductive wires separate from the plurality of first conductive wires and mounted in a lower portion of the integral, one-piece seat body, the second conductive wires having first portions extending outwardly from the planar back face in cantilevered fashion parallel to the portion of the first conductive wires, and second portions extending outwardly from the lower side of the integral one-piece seat body, the first portions of both the first and second conductive wires extending outwardly beyond a back edge of the lower side.

2. The telecommunication socket of claim 1 wherein the integral, one-piece seat body has a plurality of walls defining a front insertion hole configured to accommodate a telecommunication plug therein, the first conductive wires having second portions extending into the front insertion hole so as to be contacted by the plug inserted into the front insertion hole.

3. The telecommunication socket of claim 2 further comprising a back wall having the back face thereon, wherein the first conductive wires extend through the back wall.

4. The telecommunication socket of claim 1 wherein the integral, one-piece seat body has an L-shaped configuration.

5. The telecommunication socket of claim 4 wherein the upper portion of the integral, one-piece seat body has a plurality of guide rails in which are located the first conductive wires.

6. The telecommunication socket of claim 4 further comprising a second integral, one-piece seat body to which the integral, one-piece seat body is mounted, the second integral, one-piece seat body having a plurality of walls defining a front insertion hole for a telecommunication plug.

7. The telecommunication plug of claim 6 wherein the first conductive wires have second portions extending into the front insertion hole so as to be contacted by a plug inserted into the front insertion hole.

* * * * *